US006494970B1

(12) United States Patent
Ishii et al.

(10) Patent No.: US 6,494,970 B1
(45) Date of Patent: Dec. 17, 2002

(54) HEAT RESISTANT STEEL CASTING AND METHOD OF MANUFACTURING THE SAME

(75) Inventors: Ryuichi Ishii, Tokyo (JP); Yoichi Tsuda, Tokyo (JP); Masayuki Yamada, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/721,977

(22) Filed: Nov. 27, 2000

(30) Foreign Application Priority Data

Jul. 13, 2000 (JP) ..... 2000-212916

(51) Int. Cl.[7] ..... C22C 38/22; C22C 38/24; C22C 38/32; C21D 6/02

(52) U.S. Cl. ..... 148/334; 148/335; 148/328; 148/330; 148/548; 148/663; 420/111; 420/109

(58) Field of Search ..... 148/335, 334, 148/328, 330, 548, 663; 420/111, 109

(56) References Cited

U.S. PATENT DOCUMENTS

| | | | | |
|---|---|---|---|---|
| 4,729,872 A | | 3/1988 | Kishida et al. | 420/105 |
| 5,746,843 A | * | 5/1998 | Miyata et al. | 148/328 |
| 5,766,376 A | * | 6/1998 | Hasegawa et al. | 148/334 |

FOREIGN PATENT DOCUMENTS

| | | | | |
|---|---|---|---|---|
| EP | 0 560 375 | | 9/1993 | |
| EP | 0 787 813 A1 | | 8/1997 | |
| EP | 1 081 244 A1 | | 3/2001 | |
| JP | 62192536 | | 8/1987 | |
| JP | 63018038 | | 1/1988 | |
| JP | 1-319629 | | 12/1989 | |
| JP | 2-217439 | | 8/1990 | |
| JP | 8-269616 | * | 10/1996 | C22C/38/00 |
| JP | 8-325669 | | 12/1996 | |
| JP | 9-268343 | | 10/1997 | |
| JP | 9-296248 | | 11/1997 | |
| JP | 10-121188 | * | 5/1998 | C22C/38/00 |

* cited by examiner

*Primary Examiner*—Deborah Yee
(74) *Attorney, Agent, or Firm*—Finnegan, Henderson, Farabow, Garrett & Dunner, L.L.P.

(57) ABSTRACT

Disclosed is a heat resistant steel casting, comprising C, 0.15–0.3%, Si, 0.1–0.30%, Mn, 0.01–0.1%, Cr, 2.0–2.5%, Mo, 0.3–0.8%, V, 0.23–0.3%, W, 1.6–2.6%, N, 0.005–0.03%, B, 0.001–0.004%, impurity elements including Ni not larger than 0.2%, P not larger than 0.03% and S not larger than 0.01%, B equivalent determined by B+0.5N given below being not larger than 0.02%, Mo equivalent determined by Mo+0.5W given below falling within a range of between 1.4% and 2.0%, and C equivalent determined by C+Mn/6+Si/24+Ni/40+Cr/5+Mo/14+V/14 given below being not smaller than 0.65%, and balance of iron wherein a precipitated phase consisting of a $M_{23}C_6$ carbide, a $M_7C_3$ carbide, and MX carbonitride is a texture finely precipitated in a matrix phase, and a ratio of the precipitated phase to the matrix phase falls within a range of between 0.6% and 1.0%.

12 Claims, No Drawings

HEAT RESISTANT STEEL CASTING AND METHOD OF MANUFACTURING THE SAME

CROSS-REFERENCE TO RELATED APPLICATIONS

This application is based upon and claims the benefit of priority from the prior Japanese Patent Application No. 2000-212916, filed Jul. 13, 2000, the entire contents of which are incorporated herein by reference.

BACKGROUND OF THE INVENTION

The present invention relates to a heat resistant steel casting useful as a material of a steam turbine casing and as a material of a steam turbine valve body and to a method of manufacturing the same.

A low alloy heat resistant steel casting such as a 1.25Cr-0.5Mo cast steel or a 1Cr-1Mo-0.25V cast steel is widely used as a heat resistant steel casting material used for forming a steam turbine casing or a steam turbine valve body in a thermal power station.

On the other hand, in the thermal power station in recent years, the temperature elevation of the steam proceeds rapidly. In accordance with the temperature elevation of the steam, the change of the material of the high temperature member to a high Cr heat resistant steel casting is being vigorously promoted. The high Cr heat resistant steel casting of this kind is disclosed in, for example, Japanese Patent Publication (KOKOKU) No. 4-53928 and Japanese Patent Publication (KOKOKU) No. 3-80865. Since the high Cr heat resistant steel casting exhibits a high mechanical strength and an excellent resistance to the high temperature environment, it is possible to suppress the increase in the thickness of the high temperature member in spite of the elevation of the steam temperature. Also, since it is possible to suppress the thermal stress in the start-up and stop of the steam turbine, the steam turbine can be operated efficiently.

In recent years, the thermal power station is required to exhibit an excellent economical advantage in addition to a high thermal efficiency. Therefore, it is absolutely necessary for the material of the thermal power station to exhibit mechanical properties and manufacturing properties equal to or higher than those of the conventional material and to be excellent in economy. The material meeting these requirements includes, for example, the steel disclosed in Japanese Patent Disclosure (KOKAI) No. 2-217438 and Japanese Patent Disclosure (KOKAI) No. 8-269616.

However, the material of a high temperature member manufactured as a thick cast article is required to exhibit high temperature strength characteristics and economic properties superior to those of the steels disclosed in JP '438 and JP '616 quoted above.

BRIEF SUMMARY OF THE INVENTION

An object of the present invention, which has been achieved in view of the situation described above, is provide a heat resistant steel casting exhibiting mechanical properties excellent under an environment in which a high temperature steam flows and excellent in economical properties and a method of manufacturing the particular heat resistance cast steel.

As a result of an extensive research on a low alloy heat resistant steel casting fully comparable to the high Cr steel casting in the high temperature strength characteristics and advantageous in economy, the present inventors have arrived at the present invention summarized below.

According to an aspect of the present invention, there is provided a heat resistant steel casting, comprising C in an amount of 0.15 to 0.3 mass %, Si in an amount of 0.1 to 0.30 mass %, Mn in an amount of 0.01 to 0.1 mass %, Cr in an amount of 2.0 to 2.5 mass %, Mo in an amount of 0.3 to 0.8 mass %, V in an amount of 0.23 to 0.3 mass %, W in an amount of 1.6 to 2.6 mass %, N in an amount of 0.005 to 0.03 mass %, B in an amount of 0.001 to 0.004 mass %, impurity elements including Ni not larger than 0.2 mass %, P not larger than 0.03 mass % and S not larger than 0.01 mass %, B equivalent determined by formula (1) given below being not larger than 0.02 mass %, Mo equivalent determined by formula (2) given below falling within a range of between 1.4 mass % and 2.0 mass %, and C equivalent determined by formula (3) given below being not smaller than 0.65 mass %, and balance of iron and unavoidable impurities:

$$\text{B equivalent}=\text{B}+0.5\text{N} \quad (1)$$

$$\text{Mo equivalent}=\text{Mo}+0.5\text{W} \quad (2)$$

$$\text{C equivalent}=\text{C}+\text{Mn}/6+\text{Si}/24+\text{Ni}/40+\text{Cr}/5+\text{Mo}/14+\text{V}/14 \quad (3)$$

wherein a precipitated phase consisting of a $M_{23}C_6$ type carbide, a $M_7C_3$ type carbide, and MX type carbonitride is a texture finely precipitated in a matrix phase, and a ratio of the precipitated phase to the matrix phase falls within a range of between 0.6 and 1.0 mass %.

In this case, it is possible for the Nb equivalent determined by formula (4) given below to be not larger than 0.15%, with the V content set at 0.23 to 0.27 mass %, and with Nb content set at 0.01 to 0.06 mass %:

$$\text{Nb equivalent}=\text{Nb}+0.4\text{C} \quad (4)$$

It is also possible to set the V content at 0.23 to 0.27 mass % and to set the Ti content at 0.005 to 0.01 mass %.

Further, it is possible to set the V content at 0.25 to 0.3%.

According to another aspect of the present invention, there is provided a heat resistant steel casting, comprising C in an amount of 0.15 to 0.3 mass %, Si in an amount of 0.1 to 0.30 mass %, Mn in an amount of 0.4 to 0.7 mass %, Cr in an amount of 2.0 to 2.5 mass %, Mo in an amount of 0.3 to 0.8 mass %, V in an amount of 0.23 to 0.3 mass %, W in an amount of 1.6 to 2.6 mass %, N in an amount of 0.005 to 0.03 mass %, B in an amount of 0.001 to 0.004 mass %, impurity elements including Ni in an amount not larger than 0.5 mass %, P in an amount not larger than 0.03 mass % and S in an amount not larger than 0.01 mass %, B equivalent determined by formula (1) given below being not larger than 0.02 mass %, Mo equivalent determined by formula (2) given below falling within a range of between 1.4 mass % and 2.0 mass %, and C equivalent determined by formula (3) given below being not smaller than 0.65 mass %, and balance of iron and unavoidable impurities, wherein a precipitated phase consisting of a $M_{23}C_6$ type carbide, a $M_7C_3$ type carbide, and MX type carbonitride is a texture finely precipitated in a matrix phase, and a ratio of the precipitated phase to the matrix phase falls within a range of between 0.6 and 1.0 mass %:

$$\text{B equivalent}=\text{B}+0.5\text{N} \quad (1)$$

$$\text{Mo equivalent}=\text{Mo}+0.5\text{W} \quad (2)$$

$$\text{C equivalent}=\text{C}+\text{Mn}/6+\text{Si}/24+\text{Ni}/40+\text{Cr}/5+\text{Mo}/15+\text{V}/14 \quad (3)$$

In this case, it is possible for the Nb equivalent determined by formula (4) given below to be not larger than 0.15%, with the V content set at 0.23 to 0.27 mass %, and with Nb content set at 0.01 to 0.06 mass %:

$$\text{Nb equivalent}=\text{Nb}+0.4\text{C} \quad (4)$$

It is also possible to set the V content at 0.23 to 0.27 mass % and to set the Ti content at 0.01 to 0.025 mass %.

Further, it is possible to set the V content at 0.25 to 0.3%.

The function of each of the components described above and the reasons for specifying the composition are as described in items (a) to (p) described below. In the following description, "%" represents the mass % unless otherwise specified.

(a) C: 0.15 to 0.3%

Carbon (C) serves to ensure the hardenability, to suppress the ferrite formation, and to precipitate as a carbide or carbonitride contributing to reinforcement of precipitation. In ensuring the mechanical properties of a thick portion in casting, particularly, a large lump, it is important to ensure the hardenability and to suppress the ferrite formation. If the C content is less than 0.15%, these functions are unlikely to be performed sufficiently. On the other hand, if the C content exceeds 0.3%, the agglomeration of the precipitated carbide tends to be promoted and the welding properties tend to be lowered.

(b) Si: 0.1 to 0.3%

Silicon (Si) serves to perform the function of a deacidifying agent, to ensure a good casting properties, and to enhance the resistance to the steam oxidizing characteristics. If the Si content is lower than 0.1%, these functions tend to fail to be performed sufficiently. On the other hand, if the Si content exceeds 0.3%, the toughness is lowered so as to promote the brittleness.

(c) Mn: 0.01 to 0.1% or 0.4 to 0.7%

Manganese (Mn) serves to perform the function of a desulfurizing agent. If the Mn content is lower than 0.01%, it is difficult to obtain a sufficient desulfurizing effect. On the other hand, if the Mn content exceeds 0.1%, the creep strength tends to be lowered.

Where the heat resistant steel casting of the present invention is used as a large and thick part, it is desirable to increase the Mn addition amount because the ferrite forming tendency is increased in the thick portion by the reduction in the cooling rate in the hardening step. In order to suppress completely the ferrite formation in the thick portion, it is necessary to add Mn in an amount not smaller than 0.4%. In this case, the creep strength of the cast steel having Mn added thereto in an amount of at least 0.4% is slightly lower than that of the cast steel having Mn added thereto in an amount of 0.01 to 0.1%. However, it is possible to avoid a marked reduction in the creep strength, if the Mn addition amount is not larger than 0.7%.

(d) Cr: 2.0 to 2.5%

Chromium (Cr) serves to improve the oxidation resistance and the corrosion resistance and, at the same time, precipitates as a precipitated material contributing to the reinforcement of the precipitation. If the Cr content is lower than 2.0%, these functions tend to fail to be performed sufficiently on the other hand, if the Cr content exceeds 2.5%, the toughness and the texture stability tend to be lowered.

(e) Mo: 0.3 to 0.8%

Molybdenum (Mo) serves to contribute to the reinforcement of a solid solution and precipitates as a carbide so as to contribute to the reinforcement of the precipitation. If the Mo content is lower than 0.3%, these functions tend to fail to be performed sufficiently. On the other hand, if the Mo content exceeds 0.8%, the toughness tends to be lowered, and the ferrite formation tends to be promoted.

(f) W: 1.6 to 2.6%

Like Mo, tungsten (W) serves to contribute to the reinforcement of a solid solution and precipitates as a carbide so as to contribute to the reinforcement of the precipitation. If the cast steel contains W together with Mo, the function of reinforcing the solid solution is rendered more prominent.

In order to maintain a high W content forming a solid solution over a long period of time, it is necessary for the W content to be at least 1.6%. However, if the w content exceeds 2.6%, the toughness tends to be lowered and the ferrite formation tends to be promoted.

(g) B: 0.001 to 0.004%

Boron (B) serves to enhance the hardenability and serves to stabilize the carbonitride precipitated in the crystal boundary and in the vicinity thereof even under high temperatures so as to suppress the enlargement and coarsening of the precipitated carbonitride. If the B content is lower than 0.001%, these functions tend to fail to be performed sufficiently. On the other hand, if the B content exceeds 0.004%, the weldability tends to be impaired.

(h) N: 0.005 to 0.03%

Nitrogen (N) forms a solid solution within the matrix phase so as to contribute to the reinforcement of the solid solution and also forms a nitride or carbonitride so as to contribute to the reinforcement of the precipitation. If the N content is 0.005%, these functions tend to fail to be performed sufficiently. On the other hand, if the N content exceeds 0.03%, the enlargement and coarsening of the nitride or carbonitride are promoted so as to lower the creep strength and to promote formation of large and coarse products. It is more desirable for the N content to fall within a range of between 0.01% and 0.025%. Where the N content falls within the preferred range noted above, the texture can be further stabilized so as to further improve the creep strength.

(i) V: 0.23 to 0.3%

(i-1) V: 0.23 to 0.27% (Where V is Added Together with Nb or Ti)

(i-2) V: 0.25 to 0.3% (Where V is Added Singly)

(i-3) V: 0.23 to 0.25% (where V is Added Together With Ti and the Ti Addition Amount is 0.01 to 0.025%)

Vanadium (V) is precipitated as a fine carbonitride so as to contribute to the reinforcement of the precipitation. Where V is added together with niobium (Nb) or titanium (Ti) referred to herein later, a carbonitride of Nb or Ti is also formed in addition to the carbonitride of V so as to supplement the function of reinforcing the precipitation performed by the carbonitride of V. In the present invention, V is added in an amount of at least 0.23% in the case where Nb or Ti is added together with V. In this case, it is possible to permit precipitation of carbonitride of V at a high density and in an appropriate amount together with precipitation of carbonitride of Nb or Ti. As a result, it is possible to suppress the restoration. However, if the V content exceeds 0.27% in the case of adding Nb or Ti together with V, the carbonitride of v tends to be unduly enlarged and coarsened.

Where V is added together with Ti, it is possible to ensure a sufficient amount of precipitation by suppressing the V content to 0.25% or less and by increasing the Ti content.

On the other hand, where V is added singly without adding Nb or Ti, it is necessary to increase the V addition amount, compared with the case where Ti or Nb is added together with V, in order to permit carbonitride of V to be precipitated in an additional amount corresponding to the precipitated amount of carbonitride of Nb or Ti. Therefore, the V content is defined to be 0.25% to 0.3% in the case of adding V singly.

(j) Nb: 0.01 to 0.06%

Like V described above and like Ti that is to be described herein later, Nb permits precipitation of fine carbonitride so as to contribute to the reinforcement of precipitation. If the Nb content is lower than 0.01%, the function described above tends to fail to be performed sufficiently. If the Nb content exceeds 0.06%, however, large and coarse carbonitride is precipitated in a large amount so as to fail to perform the function of reinforcing the precipitation.

(k) Ti: 0.005 to 0.01% or 0.01 to 0.025%

Titanium (Ti) performs a deacidifying function and is precipitated as a fine carbonitride so as to contribute to the reinforcement of precipitation. These functions can be performed sufficiently where the Ti content is not lower than 0.005%. However, if the Ti content exceeds 0.01% in the case where V is added together with Ti, large and coarse carbonitride tends to be precipitated in a large amount so as to fail to perform the function of reinforcing the precipitation.

However, where the amount of V, which is added together with Ti, is suppressed to 0.25% or less, it is effective to add Ti in an amount exceeding 0.01% because the precipitation reinforcing function of the fine carbonitride is effectively exhibited.

(l) Other elements

It is desirable for the content of the unavoidable impurities other than the components described above and the main component of Fe to be as low as possible. Particularly, it is unavoidable for the impurity elements such as P, S and Ni to enter the cast steel from the raw materials. It is certainly possible to decrease the contents of these unavoidable impurities by the strict selection of the raw materials and by employment of a highly improved dissolving and steel manufacturing technologies. However, these measures are not recommendable in view of economy. Under the circumstances, the Ni content is set at 0.2% or less, the P content is set at 0.03% or less, and the S content is set at 0.01% or less.

Where the heat resistant steel casting of the present invention is used as a large and thick part, it is desirable to increase the Ni addition amount because the ferrite forming tendency is increased in the thick portion by the reduction in the cooling rate in the hardening step. Also, where it is intended to obtain an economical advantage, it is effective to set the limited amount of Ni mixed in the raw material at a high value, though the creep strength tends to be lowered if the Ni amount exceeds 0.5%. Under the circumstances, it is desirable for the Ni amount to be not larger than 0.2% or not larger than 0.5%, for the P amount to be not larger than 0.03%, and for the S amount to be not larger than 0.01%.

(m) B +0.5N ≦0.02%

B tends to perform reaction with, particularly, N to form boron nitride. The resultant boron nitride remains in the cast lump in the form of a band or a lump so as to deteriorate the mechanical properties. In the present invention, the sum of the boron content and 0.5 time the N content is defined as the B equivalent. The upper limit of the B equivalent is set at 0.02% in the present invention so as to suppress formation of the BN compound.

(n) 1.4%≦Mo+0.5W≦2.0%

As already described, the function of reinforcing the solid solution is rendered prominent by allowing the cast steel to contain both Mo and W. In the present invention, the sum of the Mo content and 0.5 time the W content is defined as the Mo equivalent, and the Mo equivalent is defined to fall within a range of between 1.4% and 2.0%. Where the Mo equivalent falls within the range noted above, the function of reinforcing the solid solution is rendered prominent, and the ferrite formation can be effectively suppressed.

(o) 0.65≦C+Mn/6+Si/24+Ni/40+Cr/5+Mo/15+V/14

As already described in conjunction with the C content, in improving the mechanical properties of the thick cast product, it is important to ensure the hardenability and to suppress the ferrite formation. In the present invention, the C content is defined to fall within the range described in item (a). Also, the value obtained from formula (3) of C+Mn/6+Si/24+Ni/40+Cr/5+Mo/15+V/14 is defined as the C equivalent, and the lower limit of the C equivalent is set at 0.65%. As a result, the hardenability can be ensured without impairing the weldability. Also, the ferrite formation can be suppressed.

(p) Nb+0.4C≦0.15%

It is known to the art that, in the case of adding Nb, large and coarse Nb carbide is precipitated when a large cast lump is coagulated, and that, where the Nb carbide remains in the cast lump, the mechanical properties are adversely affected. In the present invention, the sum of the Nb content and 0.4 time the C content is defined as the Nb equivalent. In the case of adding Nb, the Nb equivalent is defined to be 0.15% or less so as to suppress formation of large and coarse Nb carbide.

The heat resistant steel casting of the present invention is a texture in which a $M_{23}C_6$ type carbide, a $M_7C_3$ type carbide and an MX type carbonitride are finely precipitated in the matrix phase. In this case, M represents one kind of an element or a combination of at least two kinds of elements selected from the group including Cr, Mo, W, V and Nb, and X represents an element such as C or N. In the present invention, the mass ratio of the precipitated phase consisting of the $M_{23}C_6$ type carbide, $M_7C_3$ type carbide and MX type carbonitride is defined to fall within a range of between 0.6 to 1.0%. The reasons for the definition are as follows.

Each of the precipitated materials is precipitated in the tempering step included in the manufacturing method. If the ratio of the precipitated phase to the matrix phase is set at 0.6 mass % or less, it is difficult to satisfy both the creep strength and the Charpy impact strength. On the other hand, if the ratio noted above exceeds 1.0 mass %, the elements constituting the MX type carbonitride, which is newly precipitated from the matrix phase during use under high temperatures so as to contribute to the retention of the creep strength, are depleted, making it difficult to stabilize the creep strength characteristics under high temperatures.

The heat resistant steel casting of the present invention described above, which is a low alloy cast steel, exhibits excellent characteristics when used as a material of the steam turbine casing and a steam turbine valve body which are exposed to the maximum temperature of 538° C. during the normal operation, and has a creep rupture strength higher than that of the conventional 1% CrMov low alloy heat resistant steel casting. Therefore, if the heat resistant steel casting of the present invention is used for manufacturing a steam turbine casing and a steam turbine valve body, which are exposed to the maximum temperature of 538° C. during the normal operation, it is possible to decrease the thickness of the wall of the vehicle chamber and the valve box. To be more specific, the wall thickness can be decreased to about 75% of the wall thickness in the case of using the conventional 1% CrMoV low alloy heat resistant steel casting.

It should also be noted that the heat resistant steel casting of the present invention can be used in place of the conventional high Cr heat resistant steel casting as a material of the steam turbine casing and the steam turbine valve body which are exposed to the maximum temperature of 566° C. during the normal operation. It is also possible to use the heat resistant steel casting of the present invention as a material of the steam turbine casing exposed to the maximum temperature of 593° C. during the normal operation. As a result, the raw material cost can be markedly saved because the heat resistant steel casting of the present invention is a low alloy, though it is necessary to increase the wall thickness by about 25%, compared with the use of the conventional high Cr heat resistant steel casting. It follows that the vehicle chamber and the valve box noted above can be manufactured with a manufacturing cost lower than that in the past.

Further, it is possible to use in combination the heat resistant steel casting of the present invention and the conventional high Cr heat resistant steel casting in manufacturing the steam turbine casing that is exposed to the maximum temperature of 593° C. during the normal operation. To be more specific, the heat resistant steel casting of the present invention is used for forming the high temperature steam inlet portion of the steam turbine casing, which is exposed to steam having a temperature of 570° C. or more, and the conventional high Cr heat resistant steel casting or a low alloy heat resistant steel casting for forming the other portions. In this case, the member made of the heat resistant steel casting of the present invention is allowed to abut against and welded to the member made of the conventional high Cr heat resistant steel casting or the low alloy heat resistant steel casting so as to manufacture the desired steam turbine casing.

The high Cr heat resistant steel casting used in combination with the heat resistant steel casting of the present invention comprises, for example, C in an amount of 0.12 to 0.16%, Si in an amount of 0.2 to 0.35%, Mn in an amount of 0.5 to 0.7%, Ni in an amount of 0.3 to 0.6%, Cr in an amount of 9.6 to 10.6%, Mo in an amount of 0.7 to 1.0%, V in an amount of 0.2 to 0.35%, Nb in an amount of 0.07 to 0.13%, N in an amount of 0.03 to 0.06%, P in an amount of 0.02% or less, S in an amount of 0.02% or less, Al in an amount of 0.01% or less, and the balance of iron and unavoidable impurities.

On the other hand, the low alloy heat resistant steel casting used in combination with the heat resistant steel casting of the present invention comprises, for example, C in an amount of 0.12 to 0.18%, Si in an amount of 0.2 to 0.6%, Mn in an amount of 0.5 to 0.9%, Cr in an amount of 1.0 to 1.5%, Mo in an amount of 0.9 to 1.2%, V in an amount of 0.2 to 0.35%, P in an amount of 0.02% or less, S in an amount of 0.012% or less, Ni in an amount of 0.5% or less, Al in an amount of 0.01% or less, and the balance of iron and unavoidable impurities.

How to manufacture the heat resistant steel casting of the present invention will now be described.

The method of manufacturing the heat resistant steel casting of the present invention comprises the steps of retaining a cast material comprising C in an amount of 0.15 to 0.30 mass %, Si in an amount of 0.1 to 0.3 mass %, Mn in an amount of 0.01 to 0.1 mass %, Cr in an amount of 2.0 to 2.5 mass %, Mo in an amount of 0.3 to 0.8 mass %, V in an amount of 0.23 to 0.3 mass %, w in an amount of 1.6 to 2.6 mass %, N in an amount of 0.005 to 0.03 mass %, B in an amount of 0.001 to 0.004 mass %, the B equivalent defined by formula (1) below being 0.02 mass % or less, the Mo equivalent defined by formula (2) given below being 1.4 to 2.0 mass %, and the C equivalent defined by formula (3) given below being 0.65 mass % or more, impurity elements including Ni in an amount of 0.2 mass % or less, P in an amount of 0.03 mass % of less, and S in an amount of 0.01 mass %, and the balance of iron and unavoidable impurities, to fall within a temperature range of between 1030° C. and 1070° C., followed by quenching to the heated cast material, and tempering the cast material at 680 to 740° C.:

(1) B+0.5N (2) Mo+0.5W (3) C+Mn/6+Si/24+Ni/40+Cr/5+Mo/15+V/14

In this case, it is possible to set the V content at 0.23 to 0.27 mass %, to set the Nb content at 0.01 to 0.06 mass %, to set the Nb equivalent defined by formula (4) given below at 0.15% or less, and to perform the tempering step at 720 to 780° C.:

(4) Nb+0.4C

It is also possible to set the V content at 0.23 to 0.27 mass %, to set the Ti content at 0.005 to 0.01 mass %, and to perform the tempering step at 720 to 780° C.

Further, it is possible to set the v content at 0.25 to 0.3 mass %.

In the manufacturing method of the present invention, a melt containing components of the specified composition is cast in a sand mold, followed by annealing the resultant ingot. Then, the ingot is subjected to a normalizing treatment (solution treatment).

In the cooling step during the casting, V, Ti and Nb remain as large and coarse carbonitride. In the present invention, these large and coarse carbonitrides are dissolved in the austenite matrix by the normalizing treatment. If the temperature during the normalizing treatment is set lower than 1030° C., it is difficult to dissolve the large and coarse carbonitrides in the austenite matrix. On the other hand, if the temperature during the normalizing treatment exceeds 1070° C., the matrix falls outside the austenite single phase region, with the result that the metal texture obtained after the hardening step is rendered nonuniform. Under the circumstances, the temperature in the normalizing step is set to fall within the range of between 1030° C. and 1070° C.

After the normalizing treatment, a tempering treatment is applied to the cast material. In the present invention, where v alone is added without adding Ti or Nb, the tempering temperature is set to fall within a range of between 680C and 7400° C. If the tempering temperature is not lower than 680° C., the carbonitride of V can be finely precipitated, and it is possible to ensure a sufficient amount of precipitation. If the tempering temperature exceeds 740° C., however, the precipitation density of the carbonitride of V tends to be lowered.

On the other hand, where Ti or Nb is added together with V, the tempering temperature is set to fall within a range of between 720° C. and 780° C. In this case, the carbonitride of Nb or Ti can be finely precipitated, and it is possible to ensure a sufficiently large amount of the precipitation. Where the tempering temperature is lower than 720° C., however, it is difficult to ensure a sufficiently large amount of precipitation of fine carbonitride of Nb or Ti. On the other hand, if the tempering temperature exceeds 780° C., the $A_3$ transformation temperature is approached or is exceeded. In this case, the texture stability is lowered. Alternatively, the tempering treatment is excessively applied so as to impair the mechanical properties. Under the circumstances, where Ti or Nb is added together with V, the tempering temperature is set to fall within a range of between 720° C. and 780° C.

DETAILED DESCRIPTION OF THE INVENTION

Some preferred Examples of the present invention will now be described.

EXAMPLE 1

Melts of various compositions prepared in an electric furnace were cast in sand molds to obtain various ingots, followed by applying an annealing treatment to each of the ingots and subsequently applying a normalizing treatment and, then, a tempering treatment so as to obtain sample cast steels P1 to P25 and C1 to C9 as shown in Table 1. The normalizing treatment was performed by maintaining the ingot temperature at 1070° C., followed by quenching the ingot with an oil. The tempering temperature was changed depending on the kind of the sample cast steel. Specifically, the tempering temperature was set at 740° C. in the case of the steel samples having V alone added thereto, i.e., P8 to P13, P19 to P25, C1, C6 and C7. Also, the tempering temperature was set at 760° C. in the case of the steel samples having Ti or Nb added thereto together with V, i.e., P1 to P7, P14 to P18, C2 to C5, C8 and C9. The tempering temperatures for steel samples P1 to P25 fall within the range specified in the present invention. On the other hand, the tempering temperatures for steel samples C1 to C25 fail to fall within the range specified in the present invention.

TABLE 1

| No. | C | Si | Mn | Cr | Mo | V | W | Ti | Nb | N |
|---|---|---|---|---|---|---|---|---|---|---|
| P1 | 0.27 | 0.16 | 0.02 | 2.28 | 0.77 | 0.23 | 1.62 | — | 0.03 | 0.022 |
| P2 | 0.24 | 0.25 | 0.05 | 2.16 | 0.60 | 0.25 | 1.77 | — | 0.01 | 0.028 |
| P3 | 0.17 | 0.15 | 0.01 | 2.23 | 0.48 | 0.23 | 1.91 | — | 0.03 | 0.015 |
| P4 | 0.21 | 0.18 | 0.09 | 2.35 | 0.31 | 0.27 | 2.52 | — | 0.06 | 0.006 |
| P5 | 0.22 | 0.12 | 0.04 | 2.26 | 0.59 | 0.23 | 2.20 | — | 0.02 | 0.011 |
| P6 | 0.19 | 0.28 | 0.04 | 2.07 | 0.65 | 0.26 | 1.83 | — | 0.04 | 0.019 |
| P7 | 0.17 | 0.11 | 0.02 | 2.25 | 0.41 | 0.26 | 2.35 | — | 0.04 | 0.016 |
| P8 | 0.28 | 0.12 | 0.05 | 2.31 | 0.39 | 0.24 | 2.51 | — | — | 0.028 |
| P9 | 0.19 | 0.26 | 0.02 | 2.24 | 0.78 | 0.25 | 1.61 | — | — | 0.018 |
| P10 | 0.19 | 0.29 | 0.08 | 2.19 | 0.39 | 0.23 | 2.19 | — | — | 0.008 |
| P11 | 0.25 | 0.25 | 0.09 | 2.34 | 0.48 | 0.23 | 1.85 | — | — | 0.015 |
| P12 | 0.20 | 0.21 | 0.05 | 2.09 | 0.77 | 0.27 | 1.67 | — | — | 0.023 |
| P13 | 0.28 | 0.15 | 0.08 | 2.23 | 0.33 | 0.26 | 1.68 | — | — | 0.012 |
| P14 | 0.15 | 0.16 | 0.04 | 2.25 | 0.78 | 0.23 | 1.74 | 0.008 | — | 0.021 |
| P15 | 0.20 | 0.19 | 0.02 | 2.25 | 0.62 | 0.25 | 1.75 | 0.010 | — | 0.016 |
| P16 | 0.27 | 0.26 | 0.05 | 2.08 | 0.75 | 0.24 | 2.09 | 0.005 | — | 0.009 |
| P17 | 0.16 | 0.22 | 0.09 | 2.44 | 0.39 | 0.23 | 2.43 | 0.006 | — | 0.023 |
| P18 | 0.21 | 0.19 | 0.05 | 2.21 | 0.49 | 0.23 | 2.01 | 0.008 | — | 0.012 |
| P19 | 0.22 | 0.28 | 0.04 | 2.10 | 0.70 | 0.28 | 1.82 | — | — | 0.014 |
| P20 | 0.18 | 0.20 | 0.05 | 2.09 | 0.42 | 0.26 | 2.04 | — | — | 0.011 |
| P21 | 0.20 | 0.26 | 0.01 | 2.41 | 0.51 | 0.28 | 2.26 | — | — | 0.013 |
| P22 | 0.28 | 0.24 | 0.02 | 2.29 | 0.75 | 0.30 | 2.17 | — | — | 0.014 |
| P23 | 0.24 | 0.16 | 0.02 | 2.24 | 0.33 | 0.26 | 2.48 | — | — | 0.025 |
| P24 | 0.18 | 0.22 | 0.05 | 2.31 | 0.68 | 0.29 | 2.35 | — | — | 0.018 |
| P25 | 0.19 | 0.28 | 0.10 | 2.20 | 0.77 | 0.25 | 2.38 | — | — | 0.013 |
| C1 | 0.18 | 0.34 | 0.62 | 1.23 | 1.05 | 0.26 | — | — | — | 0.006 |
| C2 | 0.14 | 0.25 | 0.51 | 10.1 | 0.90 | 0.22 | — | — | 0.09 | 0.041 |
| C3 | 0.32 | 0.32 | 0.82 | 2.27 | 1.03 | 0.25 | 1.02 | — | 0.05 | 0.001 |
| C4 | 0.13 | 0.24 | 0.18 | 2.15 | 0.25 | 0.22 | 1.91 | — | 0.05 | 0.016 |
| C5 | 0.11 | 0.20 | 0.02 | 3.11 | 0.75 | 0.20 | 1.78 | — | 0.04 | 0.011 |
| C6 | 0.16 | 0.23 | 0.21 | 2.31 | 0.85 | 0.25 | 2.64 | — | — | 0.018 |
| C7 | 0.06 | 0.29 | 0.08 | 2.06 | 0.58 | 0.37 | 1.82 | — | — | 0.012 |
| C8 | 0.20 | 0.42 | 0.28 | 2.25 | 0.35 | 0.25 | 1.62 | 0.003 | — | 0.015 |
| C9 | 0.08 | 0.15 | 0.52 | 2.08 | 0.41 | 0.26 | 1.76 | 0.012 | — | 0.035 |

| No. | B | Ni | P | S | Fe | B equivalent | Nb equivalent | Mo equivalent | C equivalent |
|---|---|---|---|---|---|---|---|---|---|
| P1 | 0.004 | 0.11 | 0.008 | 0.001 | balance | 0.015 | 0.138 | 1.58 | 0.807 |
| P2 | 0.004 | 0.15 | 0.009 | 0.001 | balance | 0.018 | 0.106 | 1.49 | 0.752 |
| P3 | 0.004 | 0.15 | 0.006 | 0.001 | balance | 0.012 | 0.098 | 1.44 | 0.674 |
| P4 | 0.003 | 0.03 | 0.006 | 0.001 | balance | 0.006 | 0.144 | 1.57 | 0.743 |
| P5 | 0.003 | 0.15 | 0.008 | 0.001 | balance | 0.009 | 0.108 | 1.69 | 0.743 |
| P6 | 0.004 | 0.15 | 0.008 | 0.002 | balance | 0.014 | 0.116 | 1.57 | 0.688 |
| P7 | 0.004 | 0.09 | 0.009 | 0.001 | balance | 0.012 | 0.108 | 1.59 | 0.676 |
| P8 | 0.003 | 0.11 | 0.006 | 0.001 | balance | 0.017 | — | 1.65 | 0.801 |
| P9 | 0.001 | 0.12 | 0.009 | 0.001 | balance | 0.010 | — | 1.54 | 0.725 |
| P10 | 0.003 | 0.15 | 0.007 | 0.001 | balance | 0.007 | — | 1.49 | 0.702 |
| P11 | 0.004 | 0.15 | 0.008 | 0.001 | balance | 0.012 | — | 1.41 | 0.796 |
| P12 | 0.002 | 0.11 | 0.009 | 0.001 | balance | 0.014 | — | 1.61 | 0.708 |
| P13 | 0.004 | 0.08 | 0.006 | 0.002 | balance | 0.010 | — | 1.17 | 0.788 |
| P14 | 0.004 | 0.15 | 0.008 | 0.001 | balance | 0.015 | — | 1.65 | 0.686 |
| P15 | 0.004 | 0.05 | 0.008 | 0.001 | balance | 0.012 | — | 1.50 | 0.722 |
| P16 | 0.004 | 0.09 | 0.009 | 0.001 | balance | 0.009 | — | 1.80 | 0.775 |
| P17 | 0.003 | 0.11 | 0.008 | 0.001 | balance | 0.015 | — | 1.61 | 0.717 |
| P18 | 0.003 | 0.14 | 0.008 | 0.001 | balance | 0.009 | — | 1.50 | 0.721 |
| P19 | 0.003 | 0.10 | 0.009 | 0.001 | balance | 0.010 | — | 1.61 | 0.728 |
| P20 | 0.003 | 0.09 | 0.009 | 0.001 | balance | 0.009 | — | 1.44 | 0.663 |
| P21 | 0.002 | 0.15 | 0.008 | 0.001 | balance | 0.009 | — | 1.64 | 0.752 |
| P22 | 0.004 | 0.15 | 0.008 | 0.002 | balance | 0.011 | — | 1.84 | 0.827 |
| P23 | 0.004 | 0.15 | 0.009 | 0.001 | balance | 0.017 | — | 1.57 | 0.742 |
| P24 | 0.004 | 0.13 | 0.006 | 0.001 | balance | 0.013 | — | 1.86 | 0.729 |
| P25 | 0.003 | 0.11 | 0.009 | 0.001 | balance | 0.010 | — | 1.96 | 0.730 |

TABLE 1-continued

| | | | | | | | | | |
|---|---|---|---|---|---|---|---|---|---|
| C1 | — | 0.04 | 0.010 | 0.003 | balance | — | — | 1.05 | 0.633 |
| C2 | — | 0.53 | 0.008 | 0.001 | balance | — | 0.146 | 0.90 | 2.344 |
| C3 | — | 0.11 | 0.007 | 0.002 | balance | — | 0.128 | 1.54 | 1.013 |
| C4 | 0.007 | 0.10 | 0.010 | 0.001 | balance | 0.015 | 0.102 | 1.21 | 0.635 |
| C5 | 0.007 | 0.25 | 0.009 | 0.002 | balance | 0.013 | 0.084 | 1.64 | 0.814 |
| C6 | 0.010 | 0.12 | 0.008 | 0.001 | balance | 0.019 | — | 2.17 | 0.744 |
| C7 | 0.010 | 0.07 | 0.009 | 0.001 | balance | 0.016 | — | 1.49 | 0.564 |
| C8 | 0.0005 | 0.12 | 0.008 | 0.002 | balance | 0.008 | — | 1.16 | 0.758 |
| C9 | 0.005 | 0.11 | 0.008 | 0.001 | balance | 0.023 | — | 1.29 | 0.638 |

Test pieces were taken from the steel samples for measuring the tensile strength at room temperature. The tensile strength was found to fall within a range of between 720 and 770 MPa, supporting that the cast steel samples were substantially equal to each other in the tensile strength under room temperature.

Also, other test pieces were taken from the steel samples for applying a creep rupture test under heating at 600° C. and with a creep test at 600° C.-147MPa so as to measure the creep rupture time leading to rupture of the test piece. Further, V-notch Charpy impact test pieces (JIS No. 4) were taken from the cast steel samples and a Charpy impact test was applied to the samples at 20° C. The results of these evaluating tests are shown in Table 2. Table 2 also shows the actually measured values of the tensile strength (MPa) under room temperature of the cast steel samples.

TABLE 2

| | No. | Tensile strength at room temperature (MPa) | Creep rupture time at 600° C.-147 MPa (hour) | Absorbed energy at 20° C. (J) |
|---|---|---|---|---|
| Sample 1 | P1 | 728 | 4610 | 72 |
| Sample 2 | P2 | 740 | 4486 | 56 |
| Sample 3 | P3 | 730 | 4892 | 85 |
| Sample 4 | P4 | 732 | 5119 | 75 |
| Sample 5 | P5 | 737 | 4236 | 75 |
| Sample 6 | P6 | 735 | 4765 | 72 |
| Sample 7 | P7 | 740 | 4923 | 63 |
| Sample 8 | P8 | 722 | 3527 | 58 |
| Sample 9 | P9 | 738 | 3422 | 85 |
| Sample 10 | P10 | 725 | 3796 | 68 |
| Sample 11 | P11 | 737 | 4025 | 75 |
| Sample 12 | P12 | 731 | 3651 | 92 |
| Sample 13 | P13 | 728 | 3368 | 55 |
| Sample 14 | P14 | 718 | 3960 | 52 |
| Sample 15 | P15 | 733 | 3887 | 70 |
| Sample 16 | P16 | 736 | 3796 | 65 |
| Sample 17 | P17 | 740 | 4006 | 70 |
| Sample 18 | P18 | 736 | 3623 | 65 |
| Sample 19 | P19 | 731 | 5238 | 78 |
| Sample 20 | P20 | 725 | 4716 | 89 |
| Sample 21 | P21 | 733 | 5047 | 82 |
| Sample 22 | P22 | 738 | 6327 | 65 |
| Sample 23 | P23 | 740 | 4926 | 70 |
| Sample 24 | P24 | 738 | 4755 | 75 |
| Sample 25 | P25 | 736 | 5108 | 80 |
| Sample 26 | C1 | 735 | 512 | 29 |
| Sample 27 | C2 | 770 | 9313 | 48 |
| Sample 28 | C3 | 740 | 684 | 35 |
| Sample 29 | C4 | 728 | 1756 | 80 |
| Sample 30 | C5 | 733 | 2978 | 82 |
| Sample 31 | C6 | 722 | 3524 | 34 |
| Sample 32 | C7 | 745 | 2460 | 120 |
| Sample 33 | C8 | 737 | 2128 | 80 |
| Sample 34 | C9 | 742 | 2820 | 35 |

As shown in Table 2, the cast steels of samples 1 to 25 (steels P1 to P25) were found to have a long creep rupture time of 3368 to 6327 hours, to have a high impact absorption energy of 52 to 92 J, to have excellent creep strength characteristics, and to have excellent toughness. On the other hand, the cast steels of sample 26 (steel C1), sample 28 (steel C3) and sample 34 (steel C9) were found to have short creep rupture time of 512 hours, 684 hours, and 2820 hours, respectively, and to have a low impact absorption energy of 29J, 35J and 35J, respectively, and found to be inferior in each of the creep strength characteristics and the toughness. Also, the cast steels of sample 27 (steel C2) and sample 31 (steel C6), which certainly exhibited a long creep rupture time of 9312 hours and 3524 hours, respectively, were found to have a low impact absorption energy of 48J and 34J, respectively, and also found to be inferior in the toughness. Further, the cast steels of sample 29 (steel C4), sample 30 (steel C5), sample 32 (steel C7) and sample 33 (steel C8), which certainly exhibited a high impact absorption energy of 80J, 82J, 120J, and 80J, respectively, were found to have a short creep rupture time of 1756 hours, 2978 hours, 2460 hours and 2128 hours, respectively, indicating that the cast steels of these samples were inferior in the creep strength characteristics.

As described above, the temperature for the normalizing treatment is defined to fall within a predetermined range, and the tempering temperature is also defined to fall within a predetermined range in the method of the present invention for manufacturing a heat resistant steel casting. It has now been clarified that, where the normalizing treatment and the tempering treatment are performed under temperatures falling within the ranges specified in the present invention, steels P1 to P25 (samples 1 to 25) having a composition falling within the range specified in the present invention exhibit a tensile strength under room temperature substantially equal to that of steels C1 to C9 (samples 27 to 34) having a composition failing to fall within the range specified in the present invention. In addition, steel kinds P1 to P25 exhibit both excellent creep strength characteristics and excellent toughness.

EXAMPLE 2

In manufacturing cast steels of steel P3 (addition of both V and Nb), steel kind P11 (addition of V alone), steel P15 (addition of both V and Ti), and steel P20 (addition of V alone), the temperature for the normalizing treatment and the tempering temperature were changed in various fashions as shown in Table 3.

The texture of each of the resultant cast steels were observed so as to examine the ferrite formation and large precipitates. Further, the Charpy impact test was conducted at 20° C. as in Example 1 so as to examine the impact absorption energy (J). Table shows the results.

TABLE 3

| | Normalizing temperature (° C.) | No. | Tempering temperature (° C.) | Ferrite formation | Large precipitate undissolved in solid solution | Absorbed energy at 20° C. (J) |
|---|---|---|---|---|---|---|
| Sample 35 | 1020 | P3 | 730 | None | Present | 70 |
| Sample 36 | 1020 | P11 | 700 | None | Present | 45 |
| Sample 37 | 1020 | P15 | 700 | None | Present | 40 |
| Sample 38 | 1020 | P20 | 730 | None | Present | 72 |
| Sample 39 | 1050 | P3 | 700 | None | None | 45 |
| Sample 40 | 1050 | P3 | 730 | None | None | 70 |
| Sample 41 | 1050 | P3 | 770 | None | None | 85 |
| Sample 42 | 1050 | P3 | 800 | None | None | 15 |
| Sample 43 | 1050 | P11 | 670 | None | None | 27 |
| Sample 44 | 1050 | P11 | 730 | None | None | 68 |
| Sample 45 | 1050 | P11 | 770 | None | None | 75 |
| Sample 46 | 1050 | P11 | 800 | None | None | 12 |
| Sample 47 | 1050 | P15 | 670 | None | None | 25 |
| Sample 48 | 1050 | P15 | 730 | None | None | 58 |
| Sample 49 | 1050 | P15 | 770 | None | None | 75 |
| Sample 50 | 1050 | P15 | 800 | None | None | 12 |
| Sample 51 | 1050 | P20 | 700 | None | None | 48 |
| Sample 52 | 1050 | P20 | 730 | None | None | 76 |
| Sample 53 | 1050 | P20 | 770 | None | None | 89 |
| Sample 54 | 1050 | P20 | 800 | None | None | 15 |
| Sample 55 | 1080 | P3 | 730 | Formed | None | 72 |
| Sample 56 | 1080 | P11 | 700 | Formed | None | 48 |
| Sample 57 | 1080 | P15 | 700 | Formed | None | 42 |
| Sample 58 | 1080 | P20 | 730 | Formed | None | 79 |

In samples 35 to 38 (steels P3, P11, P15, P20), in which the normalizing treatment was carried out at 1020° C. that is lower than the lower limit of the temperature range specified in the present invention, a coarse precipitates were found, though ferrite formation was not observed in these samples. On the other hand, in samples 55 to 58 (steels P3, P11, P15, P20), in which the normalizing treatment was carried out at 1080° C. higher than the upper limit of the temperature range specified in the present invention, the ferrite formation was found, though coarse precipitates were not found. It has been found that samples 35 to 38 and 55 to 58, which certainly exhibited a high impact absorption energy, were nonuniform in texture and inferior in mechanical properties other than the toughness.

Sample 39 (steel P3), sample 43 (steel P3), sample 47 (steel P11) and sample 51 (steel P15), in which the normalizing treatment was carried out at 1050° C. falling within the temperature range specified in the present invention and the tempering treatment was carried out under the heating temperature lower than the lower limit of the range specified in the present invention, were found to have a low impact absorption energy of 45J, 27J, 25J and 48J, respectively, supporting that these samples were poor in toughness, though the ferrite formation and a coarse precipitates were not found. Also, sample 42 (steel P3), sample 46 (steel P11), sample 50 (steel P15) and sample 54 (steel P20), in which the normalizing treatment was carried out at 1050° C. falling within the temperature range specified in the present invention and the tempering treatment was carried out at the heating temperature higher than the upper limit specified in the present invention, were found to have a very low impact absorption energy of 15J, 12J, 12J, and 15J, respectively, supporting that these samples were very poor in the toughness, though the ferrite formation and the coarse precipitates were not found.

On the other hand, sample 40 (steel P3), sample 41 (steel P3), sample 44 (steel sample 45 (steel P11), sample 48 (steel P15), sample 49 (steel P15), sample 52 (steel P20) and sample 53 (steel P20), in which the normalizing treatment was carried out at 1050° C. falling within the temperature range specified in the present invention and the tempering treatment was carried out under the heating temperature falling within the range specified in the present invention, were found to form a uniform bainite texture, in which the ferrite formation and coarse precipitates were not found, and also found to have a high impact absorption energy of 70J, 85J, 68J, 75J, 58J, 75J and 89J, respectively, supporting an excellent toughness. As apparent from the experimental data, a cast steel having a composition falling within the range specified in the present invention, having a normalizing treatment applied thereto at temperature falling within the range specified in the present invention is free from coarse precipitates not forming a solid solution, permits suppressing the ferrite formation so as to exhibit a uniform texture, and exhibits satisfactory mechanical properties.

EXAMPLE 3

In this Example, cast steels of the steel kinds P3, P11, P15 and P20 shown in Table 1 were manufactured with the temperature for the normalizing treatment set at 1050° C. while changing in various fashions the heating temperature for the tempering treatment.

The mass of the test piece taken from the resultant sample cast steel was measured in advance. Then, the test piece was dipped in a methanol solution containing 10% by volume of acetyl acetone and 1% by volume of tetramethyl ammonium chloride, followed by dissolving the matrix phase in the methanol solution by electrolysis. The residue was recovered and the mass of the recovered residue was measured. Further, the mass of the matrix phase was obtained by subtracting the mass of the residue from the mass of the test piece before the dipping in the methanol solution. Still further, the mass ratio of the precipitated phase to the matrix phase was calculated by dividing the mass of the residue by the mass of the matrix phase.

Also, the creep rupture test and the Charpy impact test were conducted as in Example 1,except that the stress was set at 196 MPa, so as to examine the creep rupture time and the impact absorption energy. Table 4 shows the results.

TABLE 4

| | No. | Ratio of precipitated phase to matrix phase (mass %) | Creep rupture time at 600° C.-196 MPa (hours) | Absorbed energy at 20° C. (J) |
|---|---|---|---|---|
| Sample 59 | P 3 | 0.55 | 1803 | 25 |
| Sample 60 | P 3 | 0.63 | 1721 | 65 |
| Sample 61 | P 3 | 0.75 | 1656 | 70 |
| Sample 62 | P 3 | 0.92 | 1023 | 85 |
| Sample 63 | P 3 | 1.05 | 597 | 115 |
| Sample 64 | P11 | 0.49 | 1451 | 27 |
| Sample 65 | P11 | 0.64 | 1292 | 68 |
| Sample 66 | P11 | 0.88 | 1201 | 96 |
| Sample 67 | P11 | 1.03 | 424 | 150 |
| Sample 68 | P15 | 0.58 | 1389 | 25 |
| Sample 69 | P15 | 0.69 | 1338 | 58 |
| Sample 70 | P15 | 0.81 | 1243 | 75 |
| Sample 71 | P15 | 0.95 | 1033 | 80 |
| Sample 72 | P15 | 1.10 | 289 | 135 |
| Sample 73 | P20 | 0.51 | 1562 | 28 |
| Sample 74 | P20 | 0.71 | 1486 | 76 |
| Sample 75 | P20 | 0.95 | 1178 | 92 |
| Sample 76 | P20 | 1.08 | 480 | 120 |

In the cast steels of sample 59 (steel P3; tempering temperature of 690° C.), sample 64 (steel P11; tempering temperature of 660° C.), sample 68 (steel P15; tempering temperature of 670° C.), sample 73 (steel P20; tempering temperature of 670° C.), in which the tempering temperature was lower than the lower limit of the range specified in the present invention, the mass ratios of the precipitated phase to the matrix phase were found to be 0.55 mass %, 0.49 mass %, 0.58 mass % and 0.51 mass %, respectively. Clearly, these mass ratios were lower than the lower limit of the range specified in the present invention. Also, the cast steels of these samples 59, 64, 68 and 73 were found to have a long creep rupture time of 1830 hours, 1451 hours, 1389 hours, and 1562 hours, respectively, supporting an excellent creep strength characteristics. However, the impact absorption energies of the cast steels of these samples 59, 64, 68 and 73 were found to have impact absorption energies of 25J, 27J, 25J and 28J, respectively, supporting a very poor toughness.

Also, in the cast steels of sample 63 (steel P3; tempering temperature of 790° C.), sample 67 (steel P11; tempering temperature of 780° C.), sample 72 (steel P15; tempering temperature of 790° C.), sample 76 (steel P20; tempering temperature of 780° C.), in which the tempering temperature was higher than the upper limit of the range specified in the present invention, the mass ratios of the precipitated phase to the matrix phase were found to be 1.05 mass %, 1.03 mass %, 1.10 mass % and 1.08 mass %, respectively. Clearly, these mass ratios were higher than the upper limit of the range specified in the present invention. Also, the cast steels of these samples 63, 67, 72 and 76 were found to have impact absorption energies of 115J, 150J, 135J and 120J, respectively, supporting an excellent toughness. However, the cast steels of these samples 63, 67, 72 and 76 were found to have a very short creep rupture time of 597 hours, 424 hours, 289 hours and 480 hours, respectively, supporting very poor creep strength characteristics.

On the other hand, in the cast steels of samples 60 to 62 (steel P3; tempering temperature of 720° C., 730° C. and 770° C., respectively), samples 65 and 66 (each of steels P11;tempering temperature of 730° C. and 740° C., respectively), samples 69 to 71 (each of steels P15; tempering temperature of 730° C., 770° C. and 775° C., respectively), and samples 74 and 75 (each of steels P20; tempering temperature of 730° C. and 740° C., respectively), in which the tempering temperature fell within the range specified in the present invention, the mass ratios of the precipitated phase to the matrix phase were found to be 0.63 mass %, 0.75 mass %, 0.92 mass %, 0.64 mass %, 0.88 mass %, 0.69 mass %, 0.81 mass %, 0.95 mass %, 0.71 mass %, and 0.95 mass %, respectively. Clearly, these mass ratios fall within the range specified in the present invention. Also, the cast steels of these samples 60 to 62, 65, 66, 69 to 71, 74 and 75 were found to have a long creep rupture time of 1721 hours, 1656 hours, 1023 hours, 1292 hours, 1201 hours, 1338 hours, 1243 hours, 1033 hours, 1486 hours and 1178 hours, respectively, and to have a high impact absorption energy of 65J, 70J, 8J, 68J, 96J, 58J, 75J, 80J, 76J and 92J, supporting excellent creep strength characteristics and excellent toughness.

EXAMPLE 4

Melts of various compositions prepared in an electric furnace were cast in sand molds to obtain an ingot of sample cast steels P26 to P33 and C10 to C12 as shown in Table 5. The normalizing treatment was performed by maintaining the cast lump temperature at 1040° C. falling within the temperature range specified in the present invention, followed by applying an air cooling to the cast lump. The tempering temperature was changed depending on the kind of the sample cast steel. Specifically, the tempering temperature was set at 730° C. in the case of the steel samples having V alone added thereto, i.e., P26 to P29, C10 to C12. Also, the tempering temperature was set at 740° C. in the case of the steel samples having both V and Ti added thereto, i.e., P30 to P33. The tempering temperatures for steel samples P26 to P33 fall within the range specified in the present invention. On the other hand, the tempering temperatures for steel samples C10 to C12 fail to fall within the range specified in the present invention.

Test pieces were taken from the steel samples for measuring the tensile strength at room temperature. The tensile strength was found to fall within a range of between 720 and 770 MPa, supporting that the cast steel samples were substantially equal to each other in the tensile strength under room temperature. Further, V-notch Charpy impact test pieces (JIS No. 4) were taken from the cast steel samples and a Charpy impact test was applied to the samples at 20° C. so as to examine the impact absorption energy (J).

Also, other test pieces were taken from the cast steel samples for applying a creep rupture test at 600° C.-147 MPa so as to measure the creep rupture time leading to rupture of the test piece. The ferrite formation was not recognized in the central portion of the test piece having a thickness of 500 mm. Table 6 shows the results of the evaluations described above.

As shown in Table 6, the cast steels of samples 77 to 84 (steel kinds P26 to P33) were found to have a long creep rupture time of 3189 to 4301 hours, to have a high impact absorption energy of 72 to 96J, to have excellent creep strength characteristics, and to have excellent toughness. On the other hand, the cast steels of sample 85 (steel kind C10), sample 86 (steel kind C11) and sample 87 (steel kind C12) were found to have short creep rupture time of 2145 hours, 2196 hours, and 2098 hours, respectively, supporting that these samples were poor in the creep strength characteristics, though these samples were found to have a high impact absorption energy of 120J, 98J and 105J, respectively.

Then, the cast steel having a composition of P30 was subjected to the normalizing treatment as in Example 3,followed by recovering the extraction residue from the normalized steel by changing in various fashions the heating temperature in the step of the tempering heat treatment so as to calculate a ratio in mass of the precipitated phase to the matrix phase after the tempering treatment. Table 7 shows the results.

The cast steel of sample 88, in which the tempering temperature was set at 690° C. that was lower than the lower limit of the temperature range specified in the present invention, was found to have 0.52% of a mass ratio of the precipitated phase to the matrix phase, which was lower than the lower limit of the range specified in the present invention. It has also been found that the cast steel of sample 88, which certainly exhibited a long creep rupture time of 1722 hours, exhibits a markedly low impact absorption energy of 29 J, supporting that the cast steel was poor in impact resistance.

Also, the cast steel of sample 91,in which the tempering temperature was set at 790° C. that was higher than the upper limit of the temperature range specified in the present invention, was found to have 1.10% of a mass ratio of the precipitated phase to the matrix phase, which was higher than the upper limit of the range specified in the present invention. It has also been found that the cast steel of sample 91,which certainly exhibited an excellent impact absorption energy of 150J, supporting an excellent impact resistance, exhibits a markedly short creep rupture time of 508 hours, supporting that the cast steel was very poor in the creep strength.

On the other hand, in the cast steels of sample 89 (tempering temperature of 720° C.) and sample 90 (tempering temperature of 740° C.), in which the tempering temperatures were set to fall within the range specified in the present invention, were found to have 0.65% and 0.89%, respectively, of a mass ratio of the precipitated phase to the matrix phase, excellent creep strength characteristics (1690 hours and 1329 hours, respectively), and an excellent impact resistance (72J and 95J, respectively).

As described above, it has been found that, in manufacturing a heat resistant steel casting with the temperature for the normalizing treatment set to fall within a predetermined temperature range and with the tempering temperature set to fall within a predetermined temperature range, steel samples P26 to P33 each having the composition adjusted to fall within the range specified in the present invention do not give rise to the ferrite formation even in the thick portion and exhibit the tensile strength at room temperature substantially equal to that of steel samples C10 to C12 each having the composition adjusted not to fall within the range specified in the present invention. In addition, steel samples P26 and P33 noted above have been found to exhibit both excellent creep strength characteristics and excellent toughness.

As described above in detail, the present invention provides a heat resistant steel casting exhibiting excellent mechanical properties under an environment in which a high temperature steam flows and excellent in economy and a method of manufacturing the particular heat resistant steel casting. Therefore, the steam turbine casing or the steam turbine valve body prepared by using the heat resistant steel casting of the present invention exhibits a high reliability even under severe high temperature steam conditions, thereby producing prominent effects. For example, the present invention contributes to the improvements in the performance, the operability and the economy of the steam turbine.

TABLE 5

| No. | C | Si | Mn | Cr | Mo | V | W | Ti | N |
|---|---|---|---|---|---|---|---|---|---|
| P26 | 0.17 | 0.27 | 0.43 | 2.22 | 0.52 | 0.26 | 1.99 | — | 0.008 |
| P27 | 0.16 | 0.18 | 0.68 | 2.19 | 0.70 | 0.28 | 1.76 | — | 0.006 |
| P28 | 0.17 | 0.20 | 0.45 | 2.09 | 0.55 | 0.27 | 2.01 | — | 0.006 |
| P29 | 0.19 | 0.25 | 0.51 | 2.31 | 0.32 | 0.28 | 2.35 | — | 0.006 |
| P30 | 0.21 | 0.24 | 0.62 | 2.08 | 0.75 | 0.24 | 1.81 | 0.019 | 0.008 |
| P31 | 0.16 | 0.16 | 0.52 | 2.24 | 0.32 | 0.23 | 2.45 | 0.024 | 0.007 |
| P32 | 0.15 | 0.22 | 0.45 | 2.25 | 0.68 | 0.25 | 2.03 | 0.013 | 0.008 |
| P33 | 0.18 | 0.18 | 0.07 | 2.20 | 0.75 | 0.24 | 2.17 | 0.022 | 0.009 |
| C10 | 0.16 | 0.19 | 0.35 | 2.18 | 0.88 | 0.29 | 1.72 | — | 0.010 |
| C11 | 0.17 | 0.22 | 0.79 | 2.10 | 0.98 | 0.27 | 0.81 | — | 0.009 |
| C12 | 0.17 | 0.18 | 0.42 | 2.25 | 0.65 | 0.27 | 1.61 | — | 0.014 |

| No. | B | Ni | P | S | Fe | B equivalent | Nb equivalent | Mo equivalent | C equivalent |
|---|---|---|---|---|---|---|---|---|---|
| P26 | 0.003 | 0.24 | 0.008 | 0.001 | balance | 0.007 | — | 1.52 | 0.756 |
| P27 | 0.002 | 0.30 | 0.009 | 0.001 | balance | 0.005 | — | 1.58 | 0.793 |
| P28 | 0.003 | 0.36 | 0.008 | 0.001 | balance | 0.006 | — | 1.56 | 0.736 |
| P29 | 0.003 | 0.47 | 0.008 | 0.002 | balance | 0.006 | — | 1.50 | 0.801 |
| P30 | 0.004 | 0.18 | 0.008 | 0.002 | balance | 0.008 | — | 1.66 | 0.811 |
| P31 | 0.004 | 0.20 | 0.009 | 0.001 | balance | 0.008 | — | 1.55 | 0.744 |
| P32 | 0.004 | 0.24 | 0.006 | 0.001 | balance | 0.008 | — | 1.70 | 0.753 |
| P33 | 0.003 | 0.48 | 0.009 | 0.001 | balance | 0.008 | — | 1.84 | 0.718 |
| C10 | 0.001 | 0.72 | 0.009 | 0.002 | balance | 0.006 | — | 1.74 | 0.760 |
| C11 | 0.002 | 0.35 | 0.010 | 0.002 | balance | 0.007 | — | 1.39 | 0.824 |
| C12 | 0.001 | 0.59 | 0.008 | 0.001 | balance | 0.008 | — | 1.46 | 0.775 |

TABLE 6

| | No. | Tensile strength at room temperature ($N/mm^2$) | Creep rupture time at 600° C.-147 MPa (hour) | Absorbed energy at 20° C. (J) |
|---|---|---|---|---|
| Sample 77 | P26 | 738 | 3936 | 72 |
| Sample 78 | P27 | 731 | 3428 | 96 |
| Sample 79 | P28 | 730 | 3307 | 95 |
| Sample 80 | P29 | 742 | 3189 | 85 |

TABLE 6-continued

| | No. | Tensile strength at room temperature ($N/mm^2$) | Creep rupture time at 600° C.-147 MPa (hour) | Absorbed energy at 20° C. (J) |
|---|---|---|---|---|
| Sample 81 | P30 | 752 | 4055 | 72 |
| Sample 82 | P31 | 735 | 4301 | 85 |
| Sample 83 | P32 | 739 | 4028 | 85 |
| Sample 84 | P33 | 725 | 4227 | 72 |
| Sample 85 | C10 | 728 | 2145 | 120 |
| Sample 86 | C11 | 733 | 2196 | 98 |
| Sample 87 | C12 | 737 | 2098 | 105 |

TABLE 7

| | No. | Tempering temperature (° C.) | Amount of precipitation after tempering (mass %) | Creep rupture time at 600° C.-196 MPa (hour) | Absorbed energy at 20° C. (J) |
|---|---|---|---|---|---|
| Sample 88 | P30 | 690 | 0.52 | 1722 | 29 |
| Sample 89 | P30 | 720 | 0.65 | 1690 | 72 |
| Sample 90 | P30 | 740 | 0.89 | 1329 | 95 |
| Sample 91 | P30 | 790 | 1.10 | 508 | 150 |

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A heat resistant steel casting, comprising C in an amount of 0.15 to 0.30 mass %, Si in an amount of 0.1 to 0.30 mass %, Mn in an amount of 0.01 to 0.1 mass %, Cr in an amount of 2.0 to 2.5 mass %, Mo in an amount of 0.3 to 0.8 mass %, V in an amount of 0.23 to 0.3 mass %, W in an amount of 1.6 to 2.6 mass %, N in an amount of 0.005 to 0.03 mass %, B in an amount of 0.001 to 0.004 mass %, and balance of iron and unavoidable impurities, said unavoidable impurities including Ni, P and S, said Ni not larger than 0.2 mass %, said P not larger than 0.03 mass % and said S not larger than 0.01 mass %, B equivalent determined by formula (1) given below being not larger than 0.02 mass %, Mo equivalent determined by formula (2) given below falling within a range of between 1.4 mass and 2.0 mass %, and C equivalent determined by formula (3) given below being not smaller than 0.65 mass %

$$\text{B equivalent}=B+0.5N \quad (1)$$

$$\text{Mo equivalent}=Mo+0.5W \quad (2)$$

$$\text{C equivalent}=C+Mn/6+Si/24+Ni/40+Cr/5+Mo/15+V/14 \quad (3)$$

wherein a precipitated phase consisting of a $M_{23}C_6$ type carbide, a $M_7C_3$ type carbide, and MX type carbonitride is a texture precipitated in a matrix phase, and a ratio of the precipitated phase to the matrix phase falls within a range of between 0.60 and 1.00 mass %.

2. The heat resistant steel casting according to claim 1, wherein said cast steel contains V in an amount of 0.23 to 0.27 mass %, and further contains Ti in an amount of 0.005 to 0.01 mass %.

3. The heat resistant steel casting according to claim 1, wherein said cast steel contains V in an amount of 0.25 to 0.3 mass %.

4. A heat resistant steel casting, comprising C in an amount of 0.15 to 0.30 mass %, Si in an amount of 0.1 to 0.30 mass %, Mn in an amount of 0.4 to 0.7 mass %, Cr in an amount of 2.0 to 2.5 mass %, Mo in an amount of 0.3 to 0.8 mass %, V in an amount of 0.23 to 0.3 mass %, W in an amount of 1.6 to 2.6 mass %, N in an amount of 0.005 to 0.03 mass %, B in an amount of 0.001 to 0.004 mass %, and balance of iron and unavoidable impurities, said unavoidable impurities including Ni, P, and S, said Ni in an amount not larger than 0.5 mass %, said P in an amount not larger than 0.03 mass % and said S in an amount not larger than 0.01 mass %, B equivalent determined by formula (1) given below being not larger than 0.02 mass % Mo equivalent determined by formula (2) given below falling within a range of between 1.4 mass % and 2.0 mass %, and C equivalent determined by formula (3) given below being not smaller than 0.65 mass %, wherein a precipitated phase consisting of a $M_{23}C_6$ type carbide, a $M_7C_3$ type carbide, and MX type carbonitride is a texture precipitated in a matrix phase, and a ratio of the precipitated phase to the matrix phase falls within a range of between 0.60 and 1.00 mass %:

$$\text{B equivalent}=B+0.5N \quad (1)$$

$$\text{Mo equivalent}=Mo+0.5W \quad (2)$$

$$\text{C equivalent}=C+Mn/6+Si/24+Ni/40+Cr/5+Mo/15+V/14 \quad (3).$$

5. The heat resistant steel casting according to claims 4, wherein said V content falls within a range of between 0.23 mass % and 0.25 mass % and Ti content falls within a range of between 0.01 mass % and 0.025 mass %.

6. The heat resistant steel casting according to claim 4, wherein said V content falls within a range of between 0.25 mass % and 0.3 mass %.

7. A method of manufacturing a heat resistant steel casting, comprising the steps of:

retaining a cast material comprising C in an amount of 0.15 to 0.30 mass %, Si in an amount of 0.1 to 0.30 mass %, Mn in an amount of 0.01 to 0.1 mass %, Cr in an amount of 2.0 to 2.5 mass %, Mo in an amount of 0.3 to 0.8 mass %, V in an amount of 0.23 to 0.3 mass %, W in an amount of 1.6 to 2.6 mass %, N in an amount of 0.005 to 0.03 mass %, B in an amount of 0.001 to 0.004 mass %, B equivalent defined by formula (1) given below being 0.02 mass % or less, Mo equivalent defined by formula (2) given below being 1.4 to 2.0 mass %, and C equivalent defined by formula (3) given below being 0.65 mass % or more, and balance of iron and unavoidable impurities, said unavoidable impurities including Ni, P and S, said Ni in an amount of 0.2 mass % or less, said P in an amount of 0.3 mass % of less, and said S in an amount of 0.01 mass %, heating the cast material to fall within a temperature range of between 1030° and 1070° C. and quenching to the heated cast material:

$$\text{B equivalent}=B+0.5N \quad (1)$$

$$\text{Mo equivalent}=Mo+0.5W \quad (2)$$

$$\text{C equivalent}=C+Mn/6+Si/24+Ni/40+Cr/5+Mo/15+V/14 \quad (3);$$

and tempering the cast material at 680 to 740° C.

8. A method of manufacturing a heat resistant steel casting, comprising the steps of:

retaining a cast material comprising C in an amount of 0.15 to 0.30 mass %, Si in an amount of 0.1 to 0.30 mass %, Mn in an amount of 0.01 to 0.1 mass %, Cr in an amount of 2.0 to 2.5 mass %, Mo in an amount of 0.3 to 0.8 mass %, V in an amount of 0.23 to 0.27 mass %, Ti in an amount of 0.005 to 0.01 mass %, W in an amount of 1.6 to 2.6 mass %, N in an amount of 0.005 to 0.03 mass %, B in an amount of 0.001 to 0.004 mass %, B equivalent defined by formula (1) given below being 0.02 mass % or less, Mo equivalent defined by formula (2) given below being 1.4 to 2.0 mass %, and C equivalent defined by formula (3) given below being 0.65 mass % or more, and balance of iron and unavoidable impurities, said unavoidable impurities including Ni, P and S; said Ni in an amount of 0.2 mass % or less, said P in an amount of 0.3 mass % of less, and said S in an amount of 0.01 mass %, heating the cast material to fall within a temperature range of between 1030° and 1070° C. and quenching to the heated cast material:

$$\text{B equivalent}=\text{B}+0.5\text{N} \quad (1)$$

$$\text{Mo equivalent}=\text{Mo}+0.5\text{W} \quad (2)$$

$$\text{C equivalent}=\text{C}+\text{Mn}/6+\text{Si}/24+\text{Ni}/40+\text{Cr}/5+\text{Mo}/15+\text{V}/14 \quad (3);$$

and tempering the cast material at 720 to 780° C.

9. The method according to claim 7, wherein said cast material contains V in an amount of 0.25 to 0.3 mass %, and said tempering step is carried out at 680 to 740° C.

10. A method of manufacturing a heat resistant steel casting, comprising the steps of:

retaining a cast material comprising C in an amount of 0.15 to 0.30 mass %, Si in an amount of 0.1 to 0.30 mass %, Mn in an amount of 0.4 to 0.7 mass %, Cr in an amount of 2.0 to 2.5 mass %, Mo in an amount of 0.3 to 0.8 mass %, V in an amount of 0.23 to 0.3 mass %, W in an amount of 1.6 to 2.6 mass %, N in an amount of 0.005 to 0.03 mass %, B in an amount of 0.001 to 0.004 mass %, and balance of iron and unavoidable impurities, said unavoidable impurities including Ni, P and S, said Ni in an amount of 0.5 mass % or less, said P in an amount of 0.03 mass % of less, and said S in an amount of 0.01 mass %, B equivalent defined by formula (1) given below being 0.02 mass % or less, Mo equivalent defined by formula (2) given below being 1.4 to 2.0 mass %, and C equivalent defined by formula (3) given below being 0.65 mass % or more, to fall within a temperature range of between 1030° C. and 1070° C., followed by applying a hardening treatment to the heated cast material; and tempering the cast material at 680 to 740° C.;

$$\text{B equivalent}=\text{B}+0.5\text{N} \quad (1)$$

$$\text{Mo equivalent}=\text{Mo}+0.5\text{W} \quad (2)$$

$$\text{C equivalent}=\text{C}+\text{Mn}/6+\text{Si}/24+\text{Ni}/40+\text{Cr}/5+\text{Mo}/15+\text{V}14 \quad (3).$$

11. A method of manufacturing a heat resistant steel casting comprising the steps of:

retaining a cast material comprising C in an amount of 0.15 to 0.30 mass %, Si in an amount of 0.1 to 0.30 mass %, Mn in an amount of 0.4 to 0.7 mass %, Cr in an amount of 2.0 to 2.5 mass %, Mo in an amount of 0.3 to 0.8 mass %, V in an amount of 0.23 to 0.25 mass %, Ti content in a range of between 0.01 mass % and 0.025 mass %, W in an amount of 1.6 to 2.6 mass %, N in an amount of 0.005 to 0.03 mass %, B in an amount of 0.001 to 0.004 mass %, and balance of iron and unavoidable impurities, said unavoidable impurities including Ni, P and S, said Ni in an amount of 0.5 mass % or less, said P in an amount of 0.03 mass % of less, and said S in an amount of 0.01 mass %, B equivalent defined by formula (1) given below being 0.02 mass % or less, Mo equivalent defined by formula (2) given below being 1.4 to 2.0 mass %, and C equivalent defined by formula (3) given below being 0.65 mass % or more, to fall within a temperature range of between 1030° C. and 1070° C., followed by applying a hardening treatment to the heated cast material; and tempering under temperature falling within the range of between 720° C. and 780° C.; and $$\text{B equivalent}=\text{B}+0.5\text{N} \quad (1)$$

$$\text{Mo equivalent}=\text{Mo}+0.5\text{W} \quad (2)$$

$$\text{C equivalent}=\text{C}+\text{Mn}/6+\text{Si}/24+\text{Ni}/40+\text{Cr}/5+\text{Mo}/15+\text{V}/14 \quad (3).$$

12. The method of manufacturing a heat resistant steel casting according to claim 10, wherein said V content falls within a range of between 0.25 mass % and 0.3 mass %, and said tempering process is performed under temperature falling within a range of between 680° C. and 740° C.

* * * * *

UNITED STATES PATENT AND TRADEMARK OFFICE

CERTIFICATE OF CORRECTION

PATENT NO. : 6,494,970 B1
DATED : December 17, 2002
INVENTOR(S) : Ishii et al.

It is certified that error appears in the above-identified patent and that said Letters Patent is hereby corrected as shown below:

Column 19,
Line 48, "1.4 mass" should read -- 1.4 mass% --.
Line 50, insert comma after -- % --.

Column 20,
Line 13, insert comma after -- % --.
Line 52, "of less" should read -- or less --.

Column 21,
Lines 14 and 42, "of less" should read -- or less --.

Column 22,
Line 24, "of less" should read -- or less --.

Signed and Sealed this

Twenty-second Day of April, 2003

JAMES E. ROGAN
*Director of the United States Patent and Trademark Office*